United States Patent [19]

Dowling

[11] Patent Number: 5,018,693

[45] Date of Patent: May 28, 1991

[54] SHIPPING BRACE FOR CARDBOARD CONTAINERS

[75] Inventor: Lorne B. Dowling, Mississauga, Canada

[73] Assignee: International Brace Ltd., Canada

[21] Appl. No.: 504,627

[22] Filed: Apr. 4, 1990

[51] Int. Cl.[5] ..... E04B 1/38

[52] U.S. Cl. ..... 248/217.2; 206/423

[58] Field of Search ..... 248/217.2; 206/423, 206/561; 220/22.1

[56] References Cited

U.S. PATENT DOCUMENTS

| | | | |
|---|---|---|---|
| 974,114 | 11/1910 | Binley | 206/423 |
| 1,669,617 | 5/1928 | Kennedy | 206/423 X |
| 1,707,896 | 4/1929 | Binley | 206/423 |
| 1,993,692 | 3/1935 | Suter | 206/425 |
| 2,670,919 | 3/1954 | Esoldi | 248/217.2 X |
| 3,162,413 | 12/1964 | Hexdall | 248/217.2 X |
| 3,163,386 | 12/1964 | Collins | 248/217.2 X |
| 3,703,982 | 11/1972 | Daughtry | 206/561 |

FOREIGN PATENT DOCUMENTS

| | | | |
|---|---|---|---|
| 145911 | 7/1920 | United Kingdom | 220/22.1 |
| 241822 | 10/1925 | United Kingdom | 206/423 |
| 333744 | 8/1930 | United Kingdom | 206/423 |
| 800459 | 8/1957 | United Kingdom | 206/423 |

*Primary Examiner*—Gary L. Smith
*Assistant Examiner*—Michael Milano
*Attorney, Agent, or Firm*—W. Charles Kent; William Edgar

[57] ABSTRACT

A shipping brace for cardboard containers for long stemmed flowers, the brace comprising a bar of length sufficient to extend transversely from side to side within the container to rest on and secure in position the stems of such flowers. The bar is provided with tabs or the like at its ends, the tabs to pierce the container sides and being bendable to hold the brace in position in the container.

9 Claims, 1 Drawing Sheet

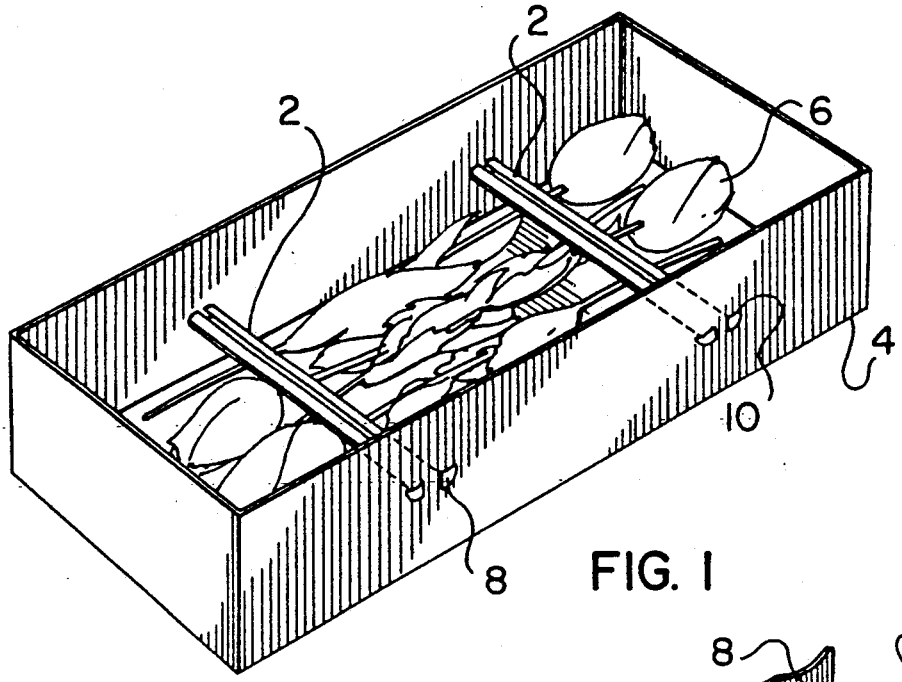
FIG. 1
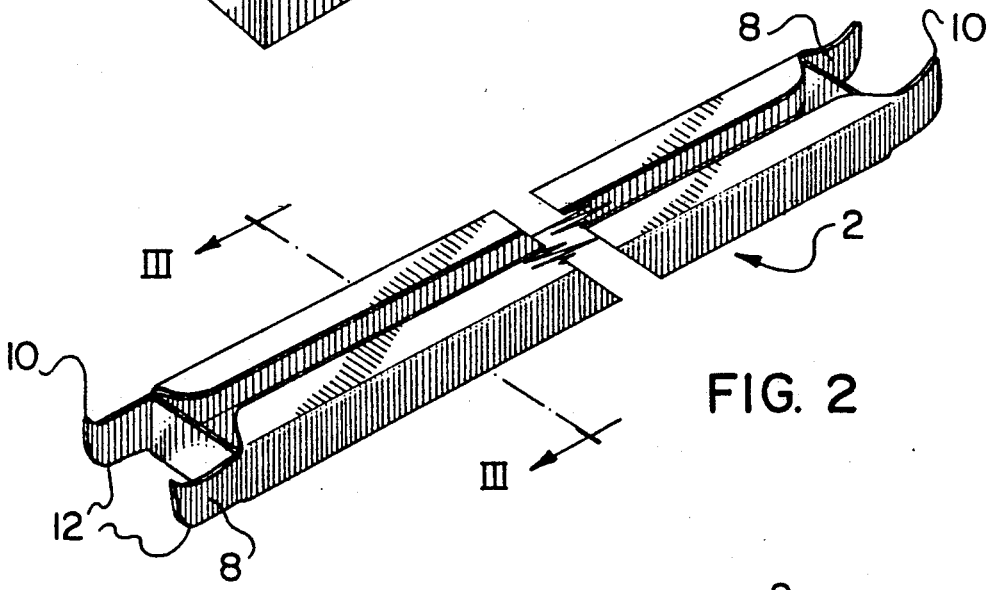
FIG. 2
FIG. 3
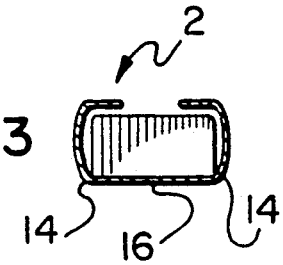

SHIPPING BRACE FOR CARDBOARD CONTAINERS

The present invention relates to a shipment brace for cardboard containers for long stemmed flowers, and more particularly to a brace which will fit within such containers to secure flowers in position and prevent them from moving around within the container during shipment.

FIELD OF THE INVENTION

The shipment of large volumes of flowers by air over long distances is becoming increasingly prevalent. Air transport enables fresh cut flowers to be shipped one region to another in a matter of hours. Thus, for example, commercial supplies of flowers such as carnations and roses for flower shops in Canada and the United States, in wintertime, are often flown in from suppliers in South America or southern parts of Europe.

A problem with shipping of flowers by air or otherwise, over long distances, exists within the fragile nature of such a product. Cut flowers are normally shipped in cardboard containers, with many dozens of such flowers being shipped in each container. Because such containers are often subjected to jarring, bumping or other forms of disruptive movement which may displace the flowers and cause them damage during transport. If a container of flowers is fully and carefully packed, this fact of itself may prevent movement of the flowers during transport. Fully packed shipping containers however may not always be possible or desirable. It has been convention to incorporate in such containers a means to immobilize the flowers and prevent them from becoming unintentionally displaced. One such means comprises a shipping brace made up of small (1 inch square cross-section) pieces of wood extending across the container from side to side and positioned to gently press against the stems of the flowers so as to immobilize the flowers during transportation. The braces are then nailed in position by driving them through the container sides, from the outside, into the ends of the brace inside the container. The corners of these wood braces tend to press into the stems of the flowers and thereby damage the flowers. As well, such braces are both expensive to use and time consuming to put in place.

In another approach to this problem, one or more wire bands have been anchored to the bottom of the container, at one side, then passed over the stems of the flowers, and then anchored to the bottom of the container at its other side. Great care has to be taken to ensure that the wire does not bear too tightly against the stems of the flowers so as to cause damage thereto.

It is an object of the present invention to provide a construction of shipping brace for cardboard containers for long stemmed flowers which is simple and inexpensive to manufacture and easy to install. It is a further object of the present invention to provide such a shipping brace which will minimize damage done to stems being held in position by the brace.

SUMMARY OF THE INVENTION

In accordance with the present invention, there is provided a shipping brace which comprises a bar of length sufficient to extend transversely, from side to side within the container to rest on and secure in proper position the stems of such flowers. The bar has at each end means to pierce the container sides from within and hold the bar in fixed position relative thereto. The bar is rounded along its edges to minimize damage to stems when the bar is in position.

In the preferred embodiment of the invention the means to pierce the container sides from within comprise a pair of spaced, sharpened, outwardly projecting planar protrusions terminating in points for piercing the container sides and projecting therethrough. The ends of the protrusion are bendable sideways for gripping the container sides.

As well, the protrusions are upwardly curved to their points, to facilitate the positioning of the bar in the container.

The shipping brace in accordance with the present invention may be made from a strip of rigid metal, the sides of which are curved to produce rounded bottom edges which will not dig into the stems of flowers held in position by the brace. This brace is extremely easy to install, requiring no nailing or the like for it to be secured in place.

While the brace in accordance with the present invention is particularly well suited to a shipment of long stemmed flowers, and will be defined and described hereinafter in this context, it will be appreciated that it may have application as a shipping brace for cardboard containers for other types of goods where it is desired to immobilized such goods during shipment in that container, against relative movement within the container. The invention is intended to cover and include such alternative applications.

BRIEF DESCRIPTION OF THE DRAWINGS

These and other objects and advantages of the invention will become apparent upon reading the following detailed description and upon referring to the drawings in which:

FIG. 1 is a perspective view of a cardboard container for long stemmed flowers, in which a shipping brace in accordance with the present invention has been inserted;

FIG. 2 is a perspective view of the brace of FIG. 1; and

FIG. 3 is a cross-section view along lines III—III of FIG. 2.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE DRAWINGS

In the drawings, similar features have been given similar reference numerals.

Turning to FIG. 1 there is illustrated a plurality of braces 2 in accordance with the present invention, positioned within cardboard shipping containers 4, to hold a plurality of long stemmed flowers 8 in position and immobilize them so that they will not move about during movement of container 4 during shipment. As can be seen in FIG. 2, brace 2 comprises an elongated bar of appropriate length to extend transversely from side to side within the container. At each end of the bar are a plurality of means to pierce the container's sides from within, these means being illustrated as being a pair of spaced, sharpened, outwardly projecting plainer protrusions 8 terminating points 10 which will pierce the container sides so that protrusions 8 can extend therethrough. These protrusions are in the form of tabs which, when they have pierced the container sides and extend outwardly, may be bend by any appropriate means, into position resting against the exterior surface of the corresponding container sides to thereby hold the bar in position. As can be seen in FIG. 2, the base 12 of the protrusions 8 is upwardly curved. This facilitates the sliding of brace 2 into position within box 4.

As can be seen in the section view of FIG. 3, brace 2 may be made of a strip of rigid metal having its sides curled upwardly and inwardly to produce rounded corners 14 at its bottom edges. When brace 2 is positioned over the stems of flowers 6 in container 4 with its base 16 resting on the stems, rounded corners 14 minimize the damage which would be done to the stems if these corners were sharp.

The brace 2 in accordance with the present invention is extremely easy to use. When flowers 6 have been appropriately laid out, presumably in a lined fashion, within container 4, the points 10 of protrusions 8 on one side of brace 2 are passed through one side of container 4 at appropriate height. The other end of brace 2 is then pivoted downwardly so that the brace rests firmly yet gently on top of the stems of the flowers 6. This pivoting action is facilitated by rounded bases 12 of protrusions 8 on this other end of brace 2. These protrusions are then passed through the corresponding side of container 4 and both sets of protrusions are appropriately bent either outwardly or inwardly, into position resting against the exterior surface of container 4 to firmly and securely hold it in position within container the 4.

Of course, any number of braces may be used as required to secure flowers 6 in position. As well, different types of flowers, or flowers having stems of different lengths, may require different braces in the same container, at the appropriate height or heights.

Of course, to remove the braces, the tabs or protrusions 8 may be readily bent to their original direction, aligned with the axis of brace 2, so that they may be removed from container 4 to enable removal of flowers 6 as required.

Another advantage of the device according to the present invention is the fact that a piece of metal, bent as illustrated (FIG. 3) may be significantly lighter than for example the prior art wooden braces over which the present invention provides significant advantages. Lighter weight of course is important in reducing the cost of transporting goods by air. As well, the device of the present invention is very easy to install, again providing a significant advantage over prior art devices.

Thus it is apparent that there has been provided in accordance with the invention a shipping brace for cardboard containers for long stemmed flowers and the like that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A shipping brace for cardboard containers for long stemmed flowers and the like, comprising a bar of integral construction of length sufficient to extend transversely, from side to side within the container, a lower surface of the bar to rest on and secure in proper position the stems of such flowers, the bar having at each end a pair of spaced, sharpened, outwardly projecting planar protrusions terminating in points for piercing the container sides at separate spaced locations and projecting therethrough to hold the bar in fixed position relative thereto, the ends of the protrusions being bendable sideways for gripping the container sides, the bar being rounded along its lower edges to minimize the damage to stems when the bar is in position.

2. A brace according to claim 1 wherein the protrusions are oriented in a direction normal to said lower surface of the bar.

3. A brace according to claim 2, wherein the protrusions are upwardly curved to their points, to facilitate the positioning of the bar in the container.

4. A brace according to claim 1, wherein the bar is made from a strip of flat rigid material, the edges of which are curved to produce rounded lower edges.

5. A brace according to claim 4, wherein the bar is made of metal.

6. A brace according to claim 1, wherein the means to pierce the container sides from within comprise sharp tabs positioned at each end of the bar, the tabs of sufficient length to extend through a corresponding side of the container, portions of the tabs extending through the container sides when the bar is in position being bendable against the container side to hold the bar in position.

7. A brace according to claim 1 of integral metal construction having a lower, flat surface with rounded edges, the ends of the lower surface terminating in a flat upwardly extending end portion to rest against the container sides when the brace is in position within the container, the protrusions outwardly extending beside each of said end portions.

8. A brace according to claim 7 wherein the protrusions are oriented in a direction normal to said lower surface of the bar.

9. A brace according to claim 8 wherein the protrusions are upwardly curved to their points to facilitate the positioning of the bar in the container.

* * * * *